US007704059B2

(12) United States Patent
Tamaoki et al.

(10) Patent No.: US 7,704,059 B2
(45) Date of Patent: Apr. 27, 2010

(54) COMPRESSOR HAVING A HELMHOLTZ TYPE RESONANCE CHAMBER WITH A LOWERMOST END CONNECTED TO A GAS PASSAGE

(75) Inventors: Taisei Tamaoki, Hachioji (JP); Takehiro Kanayama, Kusatsu (JP); Keiji Komori, Kusatsu (JP); Hiroyuki Taniwa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 363 days.

(21) Appl. No.: 11/792,302

(22) PCT Filed: Dec. 8, 2005

(86) PCT No.: PCT/JP2005/022548

§ 371 (c)(1),
(2), (4) Date: Jun. 5, 2007

(87) PCT Pub. No.: WO2006/062157

PCT Pub. Date: Jun. 15, 2006

(65) Prior Publication Data

US 2008/0085205 A1 Apr. 10, 2008

(30) Foreign Application Priority Data

Dec. 9, 2004 (JP) ..... 2004-357026

(51) Int. Cl.
*F03C 2/00* (2006.01)
*F04C 11/00* (2006.01)

(52) U.S. Cl. ..... 418/11; 418/60; 418/181; 417/310

(58) Field of Classification Search ..... 418/11, 418/60, 63, 181; 417/312, 410.3, 902
See application file for complete search history.

(56) References Cited

U.S. PATENT DOCUMENTS 6,447,274 B1 * 9/2002 Horihata et al. ..... 418/60

FOREIGN PATENT DOCUMENTS

| | | | | |
|---|---|---|---|---|
| JP | 02-176197 | A | | 7/1990 |
| JP | 02230994 | A | * | 9/1990 |
| JP | 03182693 | A | * | 8/1991 |
| JP | 07-247974 | A | | 9/1995 |
| JP | 08-144951 | A | | 6/1996 |
| JP | 2000-320479 | A | | 11/2000 |
| JP | 2001-271745 | A | | 10/2001 |
| KR | 2007023152 | A | * | 2/2007 |

* cited by examiner

*Primary Examiner*—Theresa Trieu
(74) *Attorney, Agent, or Firm*—Global IP Counselors

(57) ABSTRACT

A compressor includes a first muffler chamber communicating with a first cylinder chamber, and a second muffler chamber communicating with a second cylinder chamber. The first muffler chamber and the second muffler chamber are communicated with each other by a gas passage. The gas passage is communicated with a Helmholtz type resonance chamber by a connecting passage. The connecting passage is connected to a lowermost end of the resonance chamber. Therefore, oil contained in the refrigerant gas, even if having entered into the resonance chamber, is discharged through the connecting passage located at the lowermost end of the resonance chamber to outside of the resonance chamber. Thus, since oil is not accumulated in the resonance chamber, the resonance chamber keeps generally constant in capacity at all times.

2 Claims, 3 Drawing Sheets

COMPRESSOR HAVING A HELMHOLTZ TYPE RESONANCE CHAMBER WITH A LOWERMOST END CONNECTED TO A GAS PASSAGE

CROSS-REFERENCE TO RELATED APPLICATIONS

This U.S. National stage application claims priority under 35 U.S.C. 119(a) to Japanese Patent Application No. 2004-357026, filed in Japan on Dec. 9, 2004, the entire contents of which are hereby incorporated herein by reference.

TECHNICAL FIELD

The present invention relates to a compressor, such as rotary compressors, for use in air conditioners or the like.

BACKGROUND OF THE INVENTION

Conventionally, a compressor includes a first muffler chamber communicating with a first cylinder chamber, a second muffler chamber communicating with a second cylinder chamber, a gas passage for making the first muffler chamber and the second muffler chamber communicated with each other, and a Helmholtz type resonance chamber. A vertically intermediate portion of the resonance chamber and the gas passage are connected to each other by a connecting passage (see, e.g., JP 7-247974 A).

However, in the conventional compressor, since the connecting passage is connected to the vertically intermediate portion of the resonance chamber, oil contained in refrigerant gas may enter into the resonance chamber to accumulate in the resonance chamber, disadvantageously. This accumulation of oil in the resonance chamber would cause the resonance chamber to change in capacity, causing the frequency of damping noise (pulsation noise) to change, which leads to a degraded muffling effect as a problem.

SUMMARY OF THE INVENTION

Accordingly, an object of the present invention is to provide a compressor which is less affected by oil contained in the refrigerant gas and which is capable of maintaining the muffling effect.

In order to achieve the above object, according to the present invention, there is provided a compressor comprising:

a first muffler chamber communicating with a first cylinder chamber;

a second muffler chamber communicating with a second cylinder chamber;

a gas passage for making the first muffler chamber and the second muffler chamber communicated with each other;

a Helmholtz type resonance chamber; and a connecting passage for making a lowermost end of the resonance chamber and the gas passage with each other.

In this compressor, the refrigerant gas compressed in the first cylinder chamber is discharged to the first muffler chamber, and the refrigerant gas compressed in the second cylinder chamber is discharged to the second muffler chamber. Pulsation noise generated in this case passes through the gas passage. Then, the pulsation noise passing through the gas passage interferes with interferential waves derived from the resonance chamber, being largely damped. Thus, with the pulsation noise reduced, noise reduction becomes achievable.

Further, since the connecting passage is connected to the lowermost end of the resonance chamber, oil contained in the refrigerant gas, even if having entered into the resonance chamber, is discharged through the connecting passage located at the lowermost end of the resonance chamber to the outside of the resonance chamber. Thus, since oil is not accumulated in the resonance chamber, the resonance chamber keeps generally constant in capacity at all times. Therefore, the frequency of damping noise (pulsation noise) can be maintained generally constant, so that the muffling effect can be maintained.

According to the present invention, there is provided a compressor comprising a first muffler body, a first end plate member, a first cylinder body, an intermediate partition plate, a second cylinder body, a second end plate member and a second muffler body, as these members are placed one after another along an axial direction, in which a first cylinder chamber which is formed by the first cylinder body, the intermediate partition plate and the first end plate member, and a first muffler chamber which is formed by the first muffler body and the first end plate member are communicated with each other, and a second cylinder chamber which is formed by the second cylinder body, the intermediate partition plate and the second end plate member, and a second muffler chamber which is formed by the second muffler body and the second end plate member are communicated with each other, wherein the first muffler chamber and the second muffler chamber are communicated with each other by a gas passage which extends through the first end plate member, the first cylinder body, the intermediate partition plate, the second cylinder body and the second end plate member in the axial direction, and a lowermost end of a Helmholtz type resonance chamber which extends through the first cylinder body, the intermediate partition plate and the second cylinder body in the axial direction is connected to the gas passage via a connecting passage.

In this compressor, the refrigerant gas compressed in the first cylinder chamber is discharged to the first muffler chamber, and the refrigerant gas compressed in the second cylinder chamber is discharged to the second muffler chamber. Pulsation noise generated in this case passes through the gas passage. Then, the pulsation noise passing through the gas passage interferes with interferential waves derived from the resonance chamber, being largely damped. Thus, with the pulsation noise reduced, noise reduction becomes achievable.

Further, since the connecting passage is connected to the lowermost end of the resonance chamber, oil contained in the refrigerant gas, even if having entered into the resonance chamber, is discharged through the connecting passage located at the lowermost end of the resonance chamber to the outside of the resonance chamber. Thus, since oil is not accumulated in the resonance chamber, the resonance chamber keeps generally constant in capacity at all times. Therefore, the frequency of damping noise (pulsation noise) can be maintained generally constant, so that the muffling effect can be maintained.

In an embodiment, the resonance chamber is placed closer to the axis than the gas passage.

In this embodiment, since the resonance chamber is placed closer to the axis than the gas passage, the gas passage can be placed near peripheral edges of the first muffler body and the second muffler body. As a result of this, the first muffler chamber and the second muffler chamber can be effectively utilized in their entireties, so that the muffling effect can be improved.

In an embodiment, the connecting passage is sloped down toward the gas passage.

In this embodiment, since the connecting passage is sloped down toward the gas passage, oil in the resonance chamber, descending along the connecting passage, is securely discharged to the gas passage. Thus, the compressor is less affected by the oil contained in the refrigerant gas, so that the muffling effect can reliably be maintained.

DETAILED DESCRIPTION OF THE INVENTION

Hereinbelow, the present invention will be described in detail by way of embodiments thereof illustrated in the accompanying drawings.

First Embodiment

Figure 1:
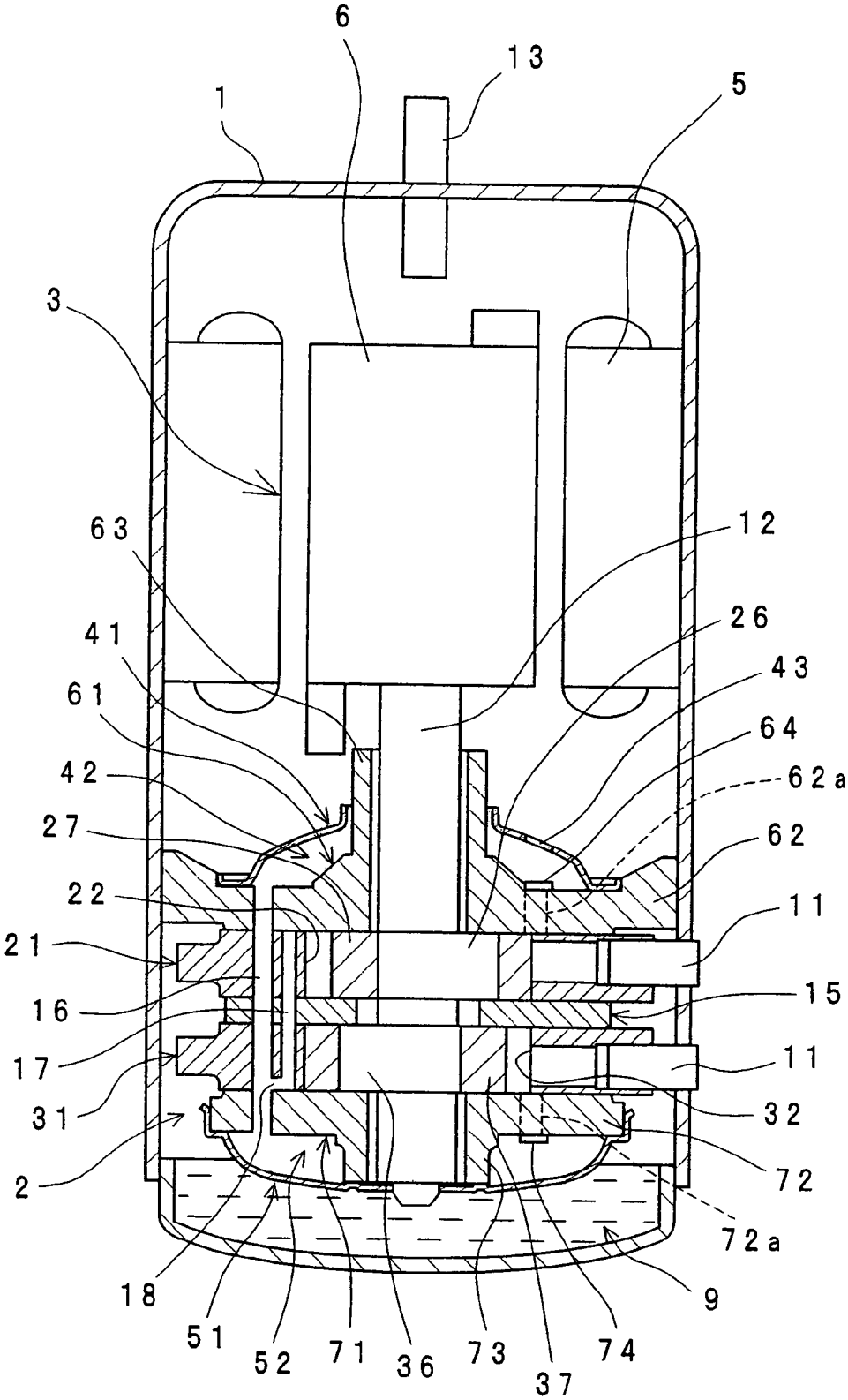
FIG. 1 is a sectional view showing an embodiment of a compressor of the present invention.

FIG. 1 shows a sectional view of an embodiment of a compressor of the present invention. This compressor, which is a so-called high-pressure dome type rotary compressor, has a compression section 2 placed below and a motor 3 placed above in a casing 1. The compression section 2 is driven via a drive shaft 12 by a rotor 6 of the motor 3.

The compression section 2 sucks up refrigerant gas from an unshown accumulator through a suction pipe 11. The refrigerant gas passes through an unshown condenser, expansion mechanism and evaporator which are combined with the compressor to constitute an air conditioner as an example of refrigeration systems.

The compressor discharges high-temperature, high-pressure compressed discharge gas from the compression section 2 to make the casing 1 filled therewith, and passes through a gap between a stator 5 and the rotor 6 of the motor 3 to cool the motor 3, thus discharging the gas outside through a discharge pipe 13. Lubricating oil 9 is accumulated at a lower portion of the high-pressure region within the casing 1.

The compression section 2 includes an upper-side first cylinder body 21 and a lower-side second cylinder body 31. Between the first cylinder body 21 and the second cylinder body 31 is provided an intermediate partition plate 15. On the first cylinder body 21, an upper-side first end plate member 61 is provided so as to be positioned on one side of the first cylinder body 21 opposite to the side on which the intermediate partition plate 15 is provided. On the second cylinder body 31, a lower-side second end plate member 71 is provided so as to be positioned on one side of the second cylinder body 31 opposite to the intermediate partition plate 15 side.

The first cylinder body 21, the intermediate partition plate 15 and the first end plate member 61 define a first cylinder chamber 22. The second cylinder body 31, the intermediate partition plate 15 and the second end plate member 71 define a second cylinder chamber 32.

The drive shaft 12 extends sequentially through the first end plate member 61, the first cylinder body 21, the intermediate partition plate 15, the second cylinder body 31 and the second end plate member 71.

A roller 27 fitted to a crankpin 26 provided on the drive shaft 12 is revolvably placed in the first cylinder chamber 22 so that compression action is exerted by revolutionary motion of the roller 27.

A roller 37 fitted to a crankpin 36 provided on the drive shaft 12 is revolvably placed in the second cylinder chamber 32 so that compression action is exerted by revolutionary motion of the roller 37.

The crankpin 26 provided in the first cylinder chamber 22 and the crankpin 36 provided in the second cylinder chamber 32 are positionally shifted from each other by 180 degrees around the drive shaft 12. That is, the first cylinder chamber 22 and the second cylinder chamber 32 differ from each other by 180 degrees in compression phase.

Now compression action of the first cylinder chamber 22 is explained below. It is noted that compression action of the second cylinder chamber 32 is similar to that of the first cylinder chamber 22 and therefore omitted in explanation.

Figure 2:
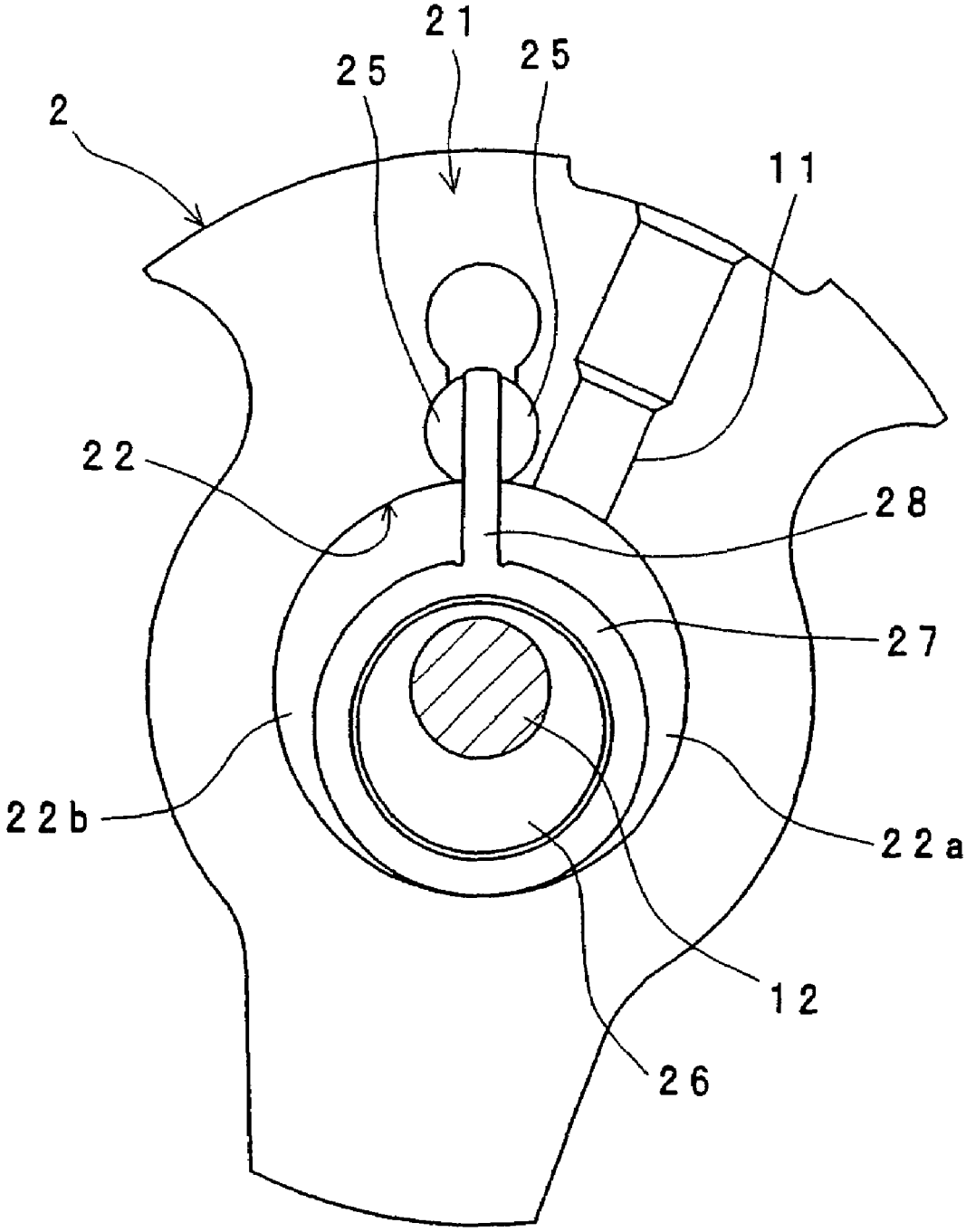
FIG. 2 is a plan view of main part of the compressor.

As shown in FIG. 2, the interior of the first cylinder chamber 22 is partitioned by a blade 28 formed integrally with the roller 27. That is, in a chamber on the right side of the blade 28, the suction pipe 11 opens in an inner surface of the first cylinder chamber 22 to form a suction chamber 22*a*. On the other hand, in a chamber on the left side of the blade 28, a discharge hole 62*a* of the first end plate member 61 (shown in FIG. 1) opens in the inner surface of the first cylinder chamber 22 to form a discharge chamber 22*b*.

Semicircular bushings 25, 25 are set in close contact with both surfaces of the blade 28 to make a sealing. Lubrication between the blade 28 and the bushings 25, 25 is done with the lubricating oil 9.

Then, as the crankpin 26 is eccentrically rotated along with the drive shaft 12, the roller 27 fitted to the crankpin 26 is revolved with the outer peripheral surface of the roller 27 kept in contact with the inner peripheral surface of the first cylinder chamber 22.

Along with the revolution of the roller 27 in the first cylinder chamber 22, the blade 28 is moved back and forth with both side faces of the blade 28 held by the bushings 25, 25. Then, the low-pressure refrigerant is sucked into the suction chamber 22*a* through the suction pipe 11, being compressed in the discharge chamber 22*b* into a higher pressure. Thereafter, the high-pressure refrigerant is discharged through the discharge hole 62*a*.

As shown in FIG. 1, the first end plate member 61 has a disc-shaped body portion 62 and a boss portion 63 provided upward at a center of the body portion 62. The drive shaft 12 is inserted to the body portion 62 and the boss portion 63. In the body portion 62, the discharge hole 62*a* is provided so as to communicate with the first cylinder chamber 22.

A discharge valve 64 is fitted to the body portion 62 so as to be located on one side of the body portion 62 opposite to the side on which the first cylinder body 21 is provided. The discharge valve 64, which is, for example, a reed valve, opens and closes the discharge hole 62*a*.

A cup-shaped first muffler body 41 is fitted to the body portion 62 so as to cover the discharge valve 64. The boss portion 63 is inserted to the first muffler body 41. The first muffler body 41 and the first end plate member 61 define a first muffler chamber 42. That is, the first muffler chamber 42 and the first cylinder chamber 22 are communicated with each other via the discharge hole 62*a*.

The first muffler body 41 has a hole portion 43. The hole portion 43 makes the first muffler chamber 42 and an outside of the first muffler body 41 communicated with each other.

The second end plate member 71 has a disc-shaped body portion 72 and a boss portion 73 provided downward at a center of the body portion 72. The drive shaft 12 is inserted to the body portion 72 and the boss portion 73. In the body portion 72, the discharge hole 72*a* is provided so as to communicate with the second cylinder chamber 32.

A discharge valve 74 is fitted to the body portion 72 so as to be located on one side of the body portion 72 opposite to the side on which the second cylinder body 31 is provided. The discharge valve 74, which is, for example, a reed valve, opens and closes the discharge hole 72*a*.

A cup-shaped second muffler body 51 is fitted to the body portion 72 so as to cover the discharge valve 74. The second muffler body 51 covers the boss portion 73. The second muffler body 51 and the second end plate member 71 define a second muffler chamber 52. That is, the second muffler chamber 52 and the second cylinder chamber 32 are communicated with each other via the discharge hole 72*a*.

A gas passage 16 is provided so as to make the first muffler chamber 42 and the second muffler chamber 52 communicated with each other. A Helmholtz type resonance chamber 17 is connected to the gas passage 16 via a connecting passage 18. This connecting passage 18 connects a lowermost end of the resonance chamber 17 and the gas passage 16 to each other.

The gas passage 16 extends through the first end plate member 61, the first cylinder body 21, the intermediate partition plate 15, the second cylinder body 31 and the second end plate member 71 one after another in the vertical direction (along the axial direction of the drive shaft 12).

The resonance chamber 17 extends through the first cylinder body 21, the intermediate partition plate 15 and the second cylinder body 31 one after another in the vertical direction (along the axial direction of the drive shaft 12). The resonance chamber 17 is placed closer to the axis of the drive shaft 12 than the gas passage 16.

The connecting passage 18 is provided by forming a groove in the lower face of the second cylinder body 31, and extends in the horizontal direction (along a direction vertical to the axis of the drive shaft 12).

With the compressor of this construction, the refrigerant gas compressed in the first cylinder chamber 22 is discharged to the first muffler chamber 42. The refrigerant gas compressed in the second cylinder chamber 32 is discharged to the second muffler chamber 52.

In this case, pulsation noise due to the discharge of the refrigerant gas occurs in the second muffler chamber 52, and this pulsation noise passes through the gas passage 16. Then, the pulsation noise passing through the gas passage 16 interferes with interferential waves derived from the resonance chamber 17, being largely damped. Thus, with the pulsation noise reduced, noise reduction becomes achievable.

More specifically, the resonance chamber 17 generates such a resonance that the pulsation noise becomes naught at boundaries with the gas passage 16. It is noted that resonance frequency of the resonance chamber 17 depends on the capacity of the resonance chamber 17.

The refrigerant gas in the second muffler chamber 52 flows through the gas passage 16 into the first muffler chamber 42, then passing through the hole portion 43 of the first muffler body 41 to flow to the outside of the first muffler body 41. Meanwhile, the refrigerant gas in the first muffler chamber 42 flows through the hole portion 43 of the first muffler body 41 to the outside of the first muffler body 41.

In addition, since the resonance chamber 17 is placed closer to the axis of the drive shaft 12 than the gas passage 16, the gas passage 16 can be placed near peripheral edges of the first muffler body 41 and the second muffler body 51. As a result of this, the first muffler chamber 42 and the second muffler chamber 52 can be effectively utilized in their entireties, so that the muffling effect can be improved.

With the compressor of this construction, since the connecting passage 18 is connected to the lowermost end of the resonance chamber 17, oil contained in the refrigerant gas, even if having entered into the resonance chamber 17, is discharged through the connecting passage 18 located at the lowermost end of the resonance chamber 17 to the outside of the resonance chamber 17. It is noted that the oil is, for example, the lubricating oil 9. Thus, since oil is not accumulated in the resonance chamber 17, the resonance chamber 17 keeps generally constant in capacity at all times. Therefore, the frequency of damping noise (pulsation noise) can be maintained generally constant, so that the muffling effect can be maintained.

Second Embodiment

Figure 3:
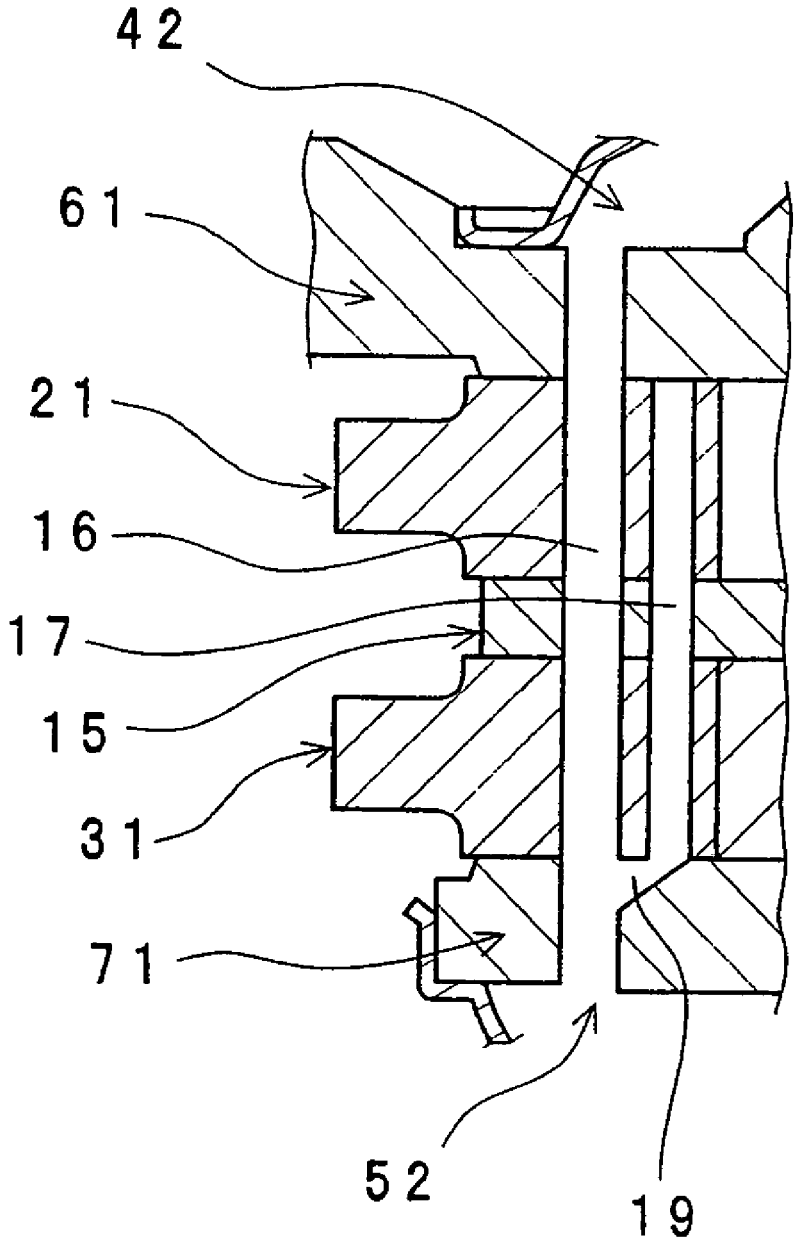
FIG. 3 is a main-part sectional view showing another embodiment of a compressor of the invention.

FIG. 3 shows a second embodiment of a compressor of the present invention. Referring to its differences from the first embodiment, the second embodiment is so designed that a connecting passage 19 for connecting the lowermost end of the resonance chamber 17 and the gas passage 16 to each other is sloped down toward the gas passage 16. It is noted that like constituent members are designated by like reference numerals in conjunction with the first embodiment and so their description is omitted.

More specifically, the connecting passage 19 is formed by forming a groove in the top face of the second end plate member 71, with the depth of the groove gradually increasing toward the gas passage 16.

With the compressor of the second embodiment, in addition to the effects of the first embodiment, since the connecting passage 19 is sloped down toward the gas passage 16, oil in the resonance chamber 17, descending along the connecting passage 19, is securely discharged to the gas passage 16. Thus, the compressor is less affected by the oil contained in the refrigerant gas, so that the muffling effect can reliably be maintained.

The present invention is not limited to the above-described embodiments. For instance, the invention may be applied to displacement type compressors or the like other than rotary compressors. Further, the cylinder chambers may also be provided three or more in number. The gas passage 16 and the resonance chamber 17 may be formed not by through holes but by other members. It is also possible that pulsation noise derived from the first cylinder chamber 22 in addition to the pulsation noise derived from the second cylinder chamber 32 passes through the gas passage 16, in which case the pulsation noise of the first cylinder chamber 22 and the pulsation noise of the second cylinder chamber 32 can be reduced by the resonance chamber 17.

What is claimed is:

1. A compressor comprising:

a first muffler body, a first end plate member, a first cylinder body, an intermediate partition plate, a second cylinder body, a second end plate member and a second muffler body, as these members are placed one after another along an axial direction of a rotational axis of the compressor, in which a first cylinder chamber which is formed by the first cylinder body, the intermediate partition plate and the first end plate member, and a first muffler chamber which is formed by the first muffler body and the first end plate member are communicated with each other, and a second cylinder chamber which is formed by the second cylinder body, the intermediate partition plate and the second end plate member, and a second muffler chamber which is formed by the second muffler body and the second end plate member are communicated with each other, wherein the first muffler chamber and the second muffler chamber are communicated with each other by a gas passage which extends through the first end plate member, the first cylinder body, the intermediate partition plate, the second cylinder body and the second end plate member in the axial direction, and a lowermost end of a Helmholtz type resonance chamber which extends through the first cylinder body, the intermediate partition plate and the second cylinder body in the axial direction is connected to the gas passage via a connecting passage wherein the resonance chamber is disposed closer to the rotational axis than the gas passage and wherein a first opening of the gas passage opens in the first muffler chamber and is located near a peripheral edge of the first muffler body in contact with the first end plate member while a second opening of the gas passage opens in the second muffler chamber and is located near a peripheral edge of the second muffler body in contact with the second end plate member.

2. The compressor as claimed in claim 1, wherein the connecting passage is sloped down toward the gas passage.

* * * * *